US010375484B2

(12) United States Patent
Meyer et al.

(10) Patent No.: US 10,375,484 B2
(45) Date of Patent: Aug. 6, 2019

(54) HEARING AID HAVING LEVEL AND FREQUENCY-DEPENDENT GAIN

(71) Applicant: Meyer Sound Laboratories, Incorporated, Berkeley, CA (US)

(72) Inventors: John D. Meyer, Berkeley, CA (US); Toban A. Szuts, El Cerrito, CA (US)

(73) Assignee: Meyer Sound Laboratories, Incorporated, Berkely, CA (US)

( * ) Notice: Subject to any disclaimer, the term of this patent is extended or adjusted under 35 U.S.C. 154(b) by 0 days.

(21) Appl. No.: 14/851,371

(22) Filed: Sep. 11, 2015

(65) Prior Publication Data

US 2016/0219380 A1 Jul. 28, 2016

Related U.S. Application Data

(63) Continuation of application No. 13/967,271, filed on Aug. 14, 2013, now Pat. No. 9,154,889.

(Continued)

(51) Int. Cl.
*H04R 25/00* (2006.01)

(52) U.S. Cl.
CPC ..... *H04R 25/353* (2013.01); *H04R 25/50* (2013.01); *H04R 25/505* (2013.01); *H04R 2225/025* (2013.01); *H04R 2460/09* (2013.01)

(58) Field of Classification Search
CPC .... H04R 25/353; H04R 25/50; H04R 25/505; H04R 25/02; H04R 25/604; H04R 25/656; H04R 2225/025; H04R 2460/09

(Continued)

(56) References Cited

U.S. PATENT DOCUMENTS 4,475,230 A 10/1984 Fukuyama et al.
5,706,352 A 6/1998 Engebretson et al.

(Continued)

FOREIGN PATENT DOCUMENTS

WO PCT/US13/55004 2/2014

OTHER PUBLICATIONS

George J. Frye, Testing Digital and Analog Hearing Instruments: Processing Time Delays and Phase Measurements A Look at Potential Side Effects and Ways of Measuring them, reprinting from The Hearing Review, Oct. 2001.

(Continued)

*Primary Examiner* — Ahmad F. Matar
*Assistant Examiner* — Sabrina Diaz
(74) *Attorney, Agent, or Firm* — Beeson Skinner Beverly, LLP

(57) ABSTRACT

An improved open-ear hearing aid to compensate for hearing loss includes a microphone for picking up incident sound and converting it to an electrical audio signal. An ear insert positionable within a human ear canal is provided for producing an output sound amplified within one or more frequency bands in response to incident sound picked up by the microphone. The in-band gain of the amplified sound output of the ear insert's loudspeaker is dependent on the user's hearing loss characteristics and the sound pressure levels of the incident sound. The form of the ear insert allows transmission of incident sound directly to the eardrum, where it is summed at the eardrum with the amplified sound output from the ear insert. Sound output is maximum at low incident sound pressure levels and minimum when the incident sound exceeds a set cut-off level.

12 Claims, 5 Drawing Sheets

Related U.S. Application Data

(60) Provisional application No. 61/683,668, filed on Aug. 15, 2012.

(58) Field of Classification Search
USPC ..... 381/312
See application file for complete search history.

(56) References Cited

U.S. PATENT DOCUMENTS

| | | | | |
|---|---|---|---|---|
| 5,903,655 | A | 5/1999 | Salmi et al. | |
| 6,108,431 | A | 8/2000 | Bachler | |
| 7,372,969 | B2 | 5/2008 | Roeck | |
| 7,474,758 | B2 | 1/2009 | Beck et al. | |
| 8,036,405 | B2 | 10/2011 | Ludvigsen et al. | |
| 8,213,653 | B2 | 7/2012 | Von Buol et al. | |
| 2007/0263891 | A1* | 11/2007 | Von Buol ..... | H04R 25/356 381/321 |

OTHER PUBLICATIONS

Frye, George J., Understanding the ANSI Standard as a Tool for Assessing Hearing Instrument Functionality, Comparing the new ANSI S3.22 2003 standard to its 1996 predecessor, The Hearing Review, May 2005.

Schum, Donald J., The Audiology in Agil, AudiologyOnline, Apr. 19, 2010.

Moore, Brian C. J., Cochlear Hearing Loss, Psyciological, Psychological and Technical Issues Second Edition, 2007, pp. 240-241, John Wiley & Sons Ltd., West Sussex, England.

Muse Kastanovich, Pass Labs Aleph 3 power amplifier, Datasheet [online], Stereophile, Apr. 29, 1997, Paragraph 5, Retrieved from the Internet, <URL: http://www.stereophile.com/solidpoweramps/674>.

P. White, Advanced Gating Techniques, Part 1, Datasheet [online], Sound on Sound, Apr. 2001, Paragraph 6, Retrieved from the Internet, <URL: http//www.soundonsound.com/sos/apr01/articles/advanced.asp>.

* cited by examiner

HEARING AID HAVING LEVEL AND FREQUENCY-DEPENDENT GAIN

CROSS-REFERENCE TO RELATED APPLICATIONS

This is a continuation of U.S. application Ser. No. 13/967,271 filed Aug. 14, 2013, which claims the benefit of U.S. Provisional Patent Application No. 61/683,668 filed Aug. 15, 2012.

BACKGROUND

The present invention generally relates to hearing aids and more particularly relates to open-ear type devices that allow incident sound to reach the eardrum directly.

Hearing aids typically consist of a microphone, a signal processor, and an output transducer (sometimes called a "receiver"). The output transducer is placed in the ear canal and can be part of a housing that either leaves the ear canal partially open (i.e., acoustically transparent) or seals the canal completely. Open-ear devices are generally preferred over closed-ear devices by users and are recommended whenever possible for persons with mild or moderate hearing loss. (Open hearing aids have inherent limitations in the amount of gain they can provide, and thus are not well suited for persons whose hearing loss is severe.)

One advantage of open-ear devices is comfort: the soft tip of open-ear designs is less irritating and easier to adapt to than hard-shell closed-ear inserts. There is also less risk of infection or impaction by cerumen (ear wax). No custom ear-mold is required, which substantially decreases the fitting time and allows such hearing aids to be used off the shelf with only minor modifications. Also avoided is the occlusion effect, where the closed ear canal forms a resonant chamber that boosts low frequency sounds generated by the user (such as speech or chewing), causing the user's voice to sound unnatural and boomy. The occlusion effect is one of the primary reasons cited when users reject closed-style hearing aids.

Open-ear designs also allow better processing in complex acoustic environments, because they allow the incident sound to be heard at frequencies where the hearing aid provides no amplification. For example, a hearing aid fit to a high frequency hearing loss (above 1 kHz) doesn't need to amplify low frequencies. The incident sound is worth preserving whenever possible because it carries perceptual cues required for localizing sound sources and rejecting background noise. Such perceptual cues include interaural timing differences, interaural loudness differences, and phase effects.

Despite their advantages, open ear hearing aids have significant drawbacks. One drawback comes from artifacts and distortion that can be produced at the eardrum by the combination of incident and amplified sound at frequencies amplified by the hearing aid. These artifacts and distortion are often noticed by users and result in dissatisfaction that leads many to stop using their hearing aids after a short period of time.

One artifact results from the latency of the hearing aid, that is, the time delay between when a sound is sensed at the microphone and when it is converted to an acoustical sound wave at the hearing aid's output transducer. For modern digital hearing aids, the latency is 3-7 milliseconds; older analog hearing aids have a latency around 1-2 milliseconds. When both the incident and amplified sounds are similar in level, non-zero latency causes comb filtering, a form of spectral distortion. Comb filtering is characterized by a series of regularly spaced spectral peaks and dips in the sound pressure at the eardrum. For longer latencies, the first dip is at a lower frequency and hence a larger portion of the frequency spectrum is affected. Shorter latencies produce less extensive comb filtering. The human ear is very sensitive to this kind of artifact; latencies shorter than 8 milliseconds are perceived as tone coloration, while longer latencies can be perceived as echos, beating, or tone coloration depending on the relative loudness of the delayed sound.

Another recombination artifact arises from phase distortion in the amplified sound. This also produces a structure of spectral dips and peaks; wherever frequencies are 180 degrees out of phase, they recombine destructively and create a dip, while those in phase add constructively, creating a peak. Since phase distortions are often spread non-uniformly over the frequency spectrum, this kind of artifact is potentially much less regular than latency artifacts. The source of phase distortion can be any component in the signal path: the microphone, signal processing components, or the output transducer (loudspeaker).

The above-mentioned artifacts result in spectral distortions to the perceived sound readily apparent to even untrained listeners. In addition to these spectral distortions, hearing aids also distort the phase information when the amplified signal is much louder than the incident signal. It is believed that such phase distortions are themselves noticeable. Recent evidence suggests that phase is used for many tasks, including source localization, speech encoding, and detection of phase modulation.

The present invention addresses the drawbacks associated with conventional open ear hearing aids. It substantially mitigates the artifacts and distortion problems that exist in open ear hearing aids, and substantially eliminates the source of user dissatisfaction with this type of hearing aid design. The invention allows the user to enjoy the well-known benefits of open-ear designs without suffering the perceptible distractions commonly associated with such designs.

SUMMARY OF INVENTION

The present invention is directed to a hearing aid comprised of input means such as a microphone for picking up incident sound to be received by the human ear and converting it to an electrical audio signal, and output means including an output transducer positionable within a human ear canal for producing a sound output in the ear in response to incident sound picked-up by the input means. The output means, which can be in the form of an ear piece or insert having a loudspeaker, is acoustically transparent to allow the transmission of incident sound to the eardrum through or by the earpiece without amplification. The perceived sound heard, by the wearer of the hearing aid results from the combination of incident sound and sound output from the output means positioned in the ear.

The invention further includes a signal processing means for processing the electrical audio signal produced by the input means in order to drive the output transducer of the output means in a desired manner. The signal processing means has a variable gain filter (sometimes referred to herein as a "coherent gate") that causes amplified sound output from the output transducer to have the following characteristics:

i) the sound output is amplified within a frequency band set in accordance with the user's hearing loss characteristics;

ii) the gain of the amplified sound output within said frequency band is dependent on the loudness, i.e. sound pressure levels, of the incident sound; and iii) the output transducer produces no perceptible sound output when the incident sound pressure level exceeds a pre-established level, whereby the sound perceived by the wearer is almost entirely the result of incident sound.

In another aspect of the invention the signal processing means produces a sound output from the output transducer characterized in that the gain of the amplified sound output within the set frequency band decreases from a maximum gain at low incident sound pressure levels to a minimum gain at incident sound pressure levels near the set cut-off sound pressure level for incident sound.

In a further aspect of the invention the input means for picking up incident sound to be received by the human ear converts the incident sound to a digital audio signal, and the signal processing means includes a digital signal processor.

In still another aspect of the invention the gain of the amplified sound output within the frequency band decreases substantially linearly with increasing low incident sound pressure levels at incident sound pressure levels below the set cut-off sound pressure level for incident sound.

Still further aspects of the invention include having the gain of the amplified sound output within said frequency band decrease rapidly near the cut-off sound pressure level for incident sound and decrease to below 0 dB at the cut-off sound pressure level for incident sound.

In yet another aspect of the invention the gain of the amplified sound output within the frequency band decreases monotonically and without discontinuities near the cut-off sound pressure level for incident sound.

In yet further aspects of the invention the phase distortion of the amplified sound output within the frequency band approaches zero near the cut-off sound pressure level for incident sound, becomes zero when the incident sound pressure level substantially exceeds the cut-off level, and approaches zero monotonically and without discontinuities near the cut-off sound pressure level for incident sound.

In still another aspect of the invention the signal processing means produces the following additional characteristic in the sound output that combines with incident sound: when transitioning between a state where the sound output is amplified and where the output transducer produces substantially no sound output, the transition is under dynamic control to produce desired attack and release times.

The present invention is also directed to a method of compensating for hearing loss in an individual having hearing loss. The method generally comprises first determining the frequency dependent hearing loss characteristics of the individual, including a loudness threshold of audibility above which the individual has substantially normal hearing capabilities. Two paths for incident sound to travel to the eardrum of the individual's ear having hearing loss are provided, including a direct open ear path and a processed signal path. The processed signal path delivers a sound output at the individual's eardrum that combines with incident sound arriving at the eardrum through the open ear direct path and more particularly delivers a sound output at the eardrum having the following characteristics:

i) the sound output is amplified within a frequency band set in accordance with the user's hearing loss characteristics;

ii) the gain of the amplified sound output within said frequency band is dependent on the sound pressure levels of the incident sound; and iii) the output transducer produces substantially no sound output when the incident sound pressure level approximately exceeds the individual's threshold of audibility, whereby the sound perceived by the individual is almost entirely the result of incident sound arriving at the eardrum through the open ear direct path.

The present invention provides a number of benefits. By attenuating the amplified sound at the user's threshold of audibility, the output transducer of the hearing aid does not need to provide a loud output level, and hence can be used without danger of clipping or limiters. Both limiters and clipping introduce harmonic distortion in the amplified signal; limiters do so by design, to avoid the more extreme artifacts caused by clipping, which is the excitation of nonlinear modes in the diaphragm.

Furthermore, the invention will increase the number and quality of spatial cues available to the user. Such cues result from the complete head-related transfer function, which is shaped by the external ear anatomy (pinna and concha), the ear canal, and binaural effects caused by the head (such as interaural loudness, timing, and phase differences). Whenever a frequency is amplified, latency and phase distortions are necessarily introduced at that frequency and natural cues are perturbed. The invention, and particularly the coherent gate of the invention, preserves natural cues by judicious amplification of incident sound.

On a more general level, the invention improves sound quality perceived by the user while preserving natural cues, so that the hearing aid is the least taxing for the user. In complex auditory environments, the brain can use multiple cues to separate sound sources and direct auditory attention. In many cases, loss of such cues results in reduced comprehension or intelligibility. However, recent studies have shown that loss of certain cues may also increase the cognitive effort required to maintain the same performance. This is shown most succinctly by giving the test subject a second, non-auditory task to perform along with the primary auditory task. With hearing loss, degraded input quality, or other factors that increase cognitive load, performance on the second task will drop dramatically and the patient will fatigue much more quickly than normal.

Other aspects and benefits of the invention will be apparent from the description and claims which follow.

DESCRIPTION OF THE ILLUSTRATED EMBODIMENT

Figure 1:
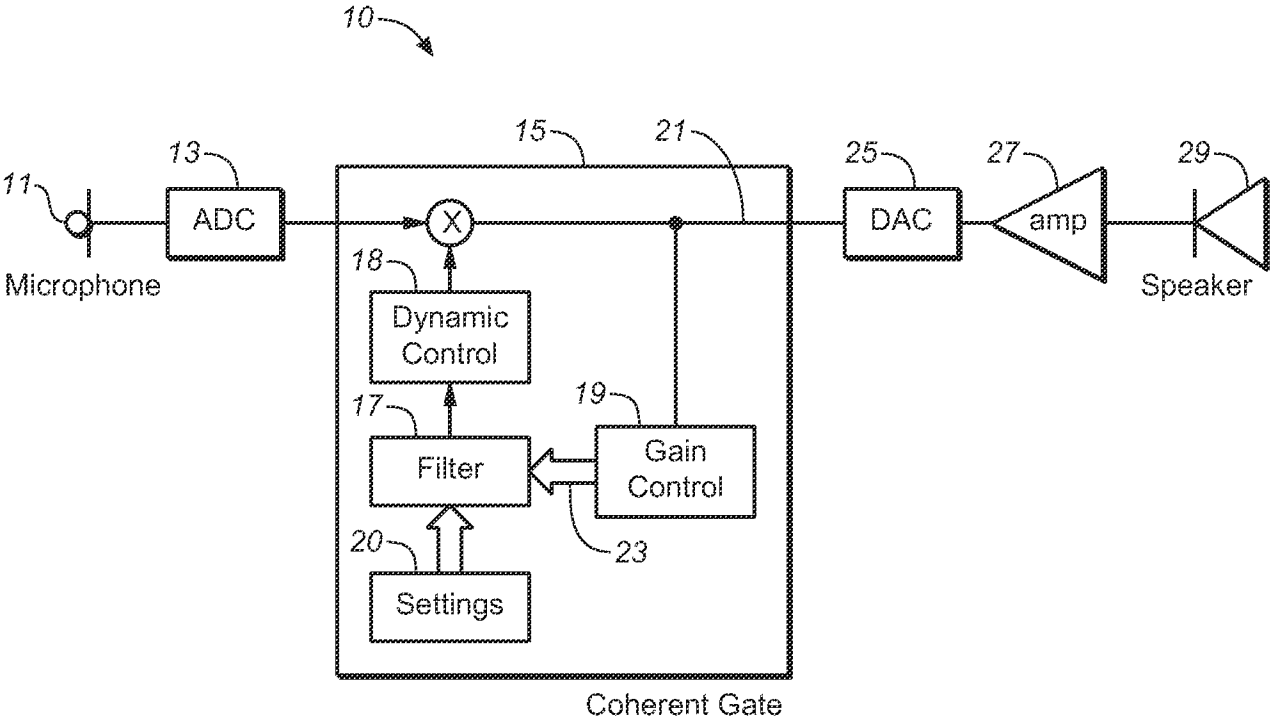
FIG. 1 is a functional block diagram representation of a aid having a coherent gate in accordance with the invention.

Referring to the drawings, FIG. 1 illustrates in block diagram form an embodiment of a hearing aid in accordance with the invention, generally denoted by the numeral 10, wherein input (incident) sound is transduced by the microphone 11 and digitized by an analog-to-digital converter 13 for digital processing. (It will be understood that the invention is not limited to digital processing, and could be implemented instead with analog components.) The signal is then passed through a signal processing circuit having a coherent gate 15 comprised of a filter 17, a gain control function 19 for providing variable gain, and preferably a later described dynamic control function represented by block 18. The filter's parameters (shape, bandwidth, gain structure, etc.) are set via a settings function within the coherent gate as represented by settings block 20. When in a settings or programming mode, the parameters of the coherent gate (including frequency and gain, among others) can be set to the user's particular hearing loss. These settings function can be controlled by a computer.

As represented by gain control block 19, the gain supplied by the hearing aid can be determined from the coherent gate's output signal at gate output 21 in a feedback configuration, and can be used to modify the amplitude of the filter as represented by feedback arrow 23. The output signal can then be converted to an analog signal by a digital-to-analog convertor 25, amplified by amplifier 27, and passed to output transducer (loudspeaker) 29. It will be appreciated that gain control could be implemented in ways other than described above, for example, using a feed-forward signal.

Most suitably, the input transducer (microphone) and output transducer (loudspeaker) will reproduce the audio signal accurately without adding spectral or phase distortion. This requires linear transducers with a flat phase response and no harmonic distortion up to the highest level of gain needed. Since hearing losses appropriate to this invention are mild to moderate, the hearing aid will rarely need to provide levels in excess of 80 dB SPL.

Figure 2:
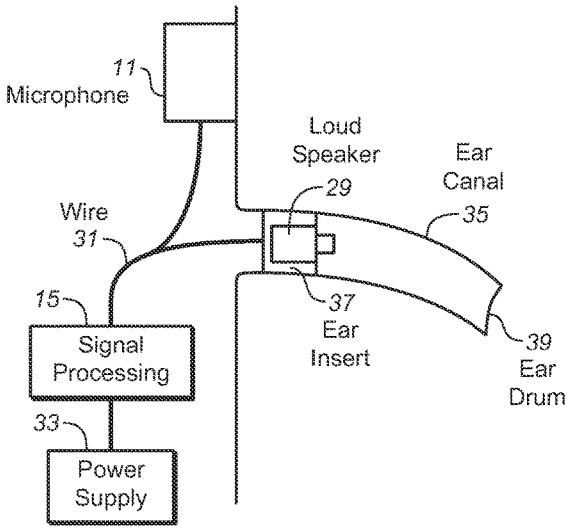
FIG. 2 is a graphical representation of physical components for a hearing aid in accordance with the invention, and component placement both outside and inside the ear canal.

A physical implementation of a hearing aid in accordance with the invention is shown in FIG. 2. The microphone 11 is connected to an electronic package containing coherent gate 15 and the output transducer 29 by a wire 31. While the processing electronics (which includes the coherent gate) and microphone are shown as separate components, it is contemplated that they can be housed together in a single wearable unit. A power supply such as a battery 33 can likewise be housed together with the processing electronics or may be located separately and attached to the circuit by a wire. An ear insertable acoustic output means includes output transducer 29 and an acoustically transparent ear insert 37. Suitably, the transducer is embedded in the ear insert. The insert is held in the outer portion of the ear canal 35, which means that the incident sound is not appreciably attenuated and can still reach the eardrum 39. Such an ear insert is called an 'open-ear' design, in contrast to a hard ear insert that blocks the ear canal completely and attenuates the incident sound. (Where the context requires, reference herein to "ear insert" shall be understood to include the transducer 29.)

Figure 3:
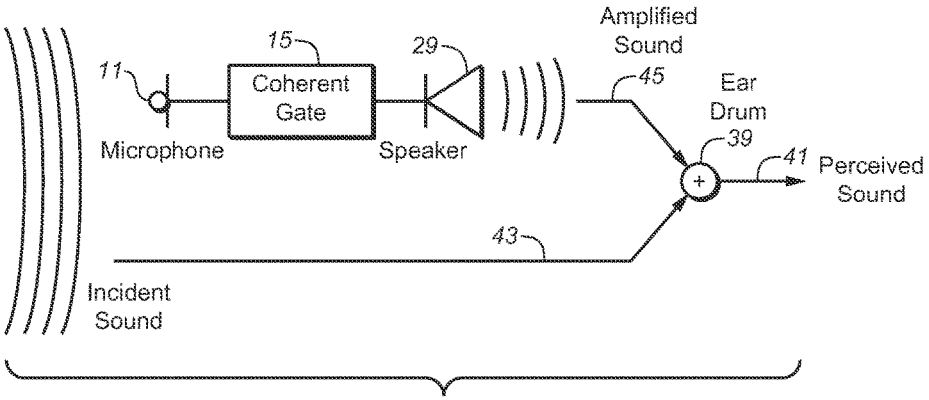
FIG. 3 is a schematic/graphical representation of the paths taken by amplified and incident sound as they pass through the ear canal to the eardrum of a person fitted with a hearing aid in accordance with the invention; it illustrates how the incident and amplified sound sum and create the perceived sound when they reach the eardrum.

Such an open ear insert allows incident sounds to reach the eardrum, as shown schematically in FIG. 3. When the device is worn and inactive, the sound perceived at the eardrum 39 (represented by output arrow 41) is simply the incident sound (represented by input arrow 43). When the device is active, it creates a sound sometimes referred to herein as the "amplified sound." Both the amplified sound (represented by arrow 45) and the incident sound 43 excite the eardrum; the sound perceived by the brain is thus their summation.

As above-mentioned, the frequency spectrum of the amplified sound is determined by the parameters of the filter 17 of coherent gate 15, which can be controlled by a computer via the coherent gate's setting function 20. (A computer interface can be provided to programmatically determine the filter shape of the coherent gate.) The filter can be thought of as an equalization curve, applying gain separately to narrow bands of frequency. The shape of the filter is highly customizable and can be adapted to most kinds of mild or moderate hearing loss, although ultimately it is limited by the design of the coherent gate algorithm. For instance, the filter may be flat across all frequencies, boosted at particular frequencies (high-pass, low-pass, or band-pass), or bimodal (peaking at two frequencies).

The characteristics of the coherent gate 15 of the signal processing circuit can first be established by setting a frequency-dependent gain (equalization) curve, hence "filter," tailored to the user's particular measured hearing loss. The filter thusly established is preferably a minimum phase filter, that is, a filter where phase is altered only at those frequencies that are amplified. As the input level (incident sound) in one frequency band increases, the filter gain can gradually be attenuated until the incident sound becomes dominant. The gain can be attenuated in such a way that the phase response also gradually decreases to zero. The precise filter characteristics needed to compensate for the hearing loss for a particular individual can be referred to as a "fitting algorithm."

Fitting algorithms for a user's particular hearing loss can be determined by testing the hearing of the user. The fitting algorithm can provide customized gain control for the coherent gate (filter) circuit: it amplifies a given frequency band only when below the user's threshold of audibility. When amplifying soft sounds, the phase delay of the filter is acceptable to the user and audibility for low level speech and music is greatly improved. Once the input signal reaches the user's threshold, however, the effects of the filter are removed, preferably rapidly, which also removes distortion. (If the filter remains active above the threshold of audibility, the resulting sound is heard as distorted and unpleasant to the user: the perception can be bright or boomy, depending on the type of hearing loss.)

Other characteristics of the coherent gate are the dynamic properties of each filter. These include the attack and release times, which are the time required for a filter to fully engage as the loudness of incident sound rises above the person's threshold of audibility and to fully disengage as the loudness of incident sound falls below this threshold. By employing dynamic control, (graphically represented by block 18 in FIG. 1), the attack and release times can be suitably set such that sudden loud events aren't amplified, requiring a fast attack time, and such that soft sounds following a loud event remain audible, which requires a moderately fast release time. If either parameter is too long or too short, there will be tone coloration and noticeable level fluctuation; if the release time is too short, pumping artifacts will be noticed. The values of the dynamics will likely depend on the user's particular hearing loss and subjective feedback from the user during the fitting process. Generally, the filter attack time would suitably be set somewhere between about 15 microseconds and about 10 milliseconds, and preferably less than about 1 millisecond. The filter release time would preferably be in a range of about 200 microseconds to 30 milliseconds. These dynamics would most suitably be set by the manufacturer or trained professional.

While the hearing aid described above is a single channel device for one ear, it shall be understood that an appropriate combination of two such devices could be used for both ears. In such a case, the combination could share a physical enclosure for the electronics and a battery, but each ear would require its own ear insert, and preferably each ear would have its own a dedicated microphone and coherent gate. Separate microphones are recommended to preserve binaural cues, which are different at each ear. The coherent gate will preferably be independently set for each ear because hearing loss in each ear is often different (called asymmetric hearing loss). The microphones will preferably be worn as close to the ear as possible.

Figure 4:
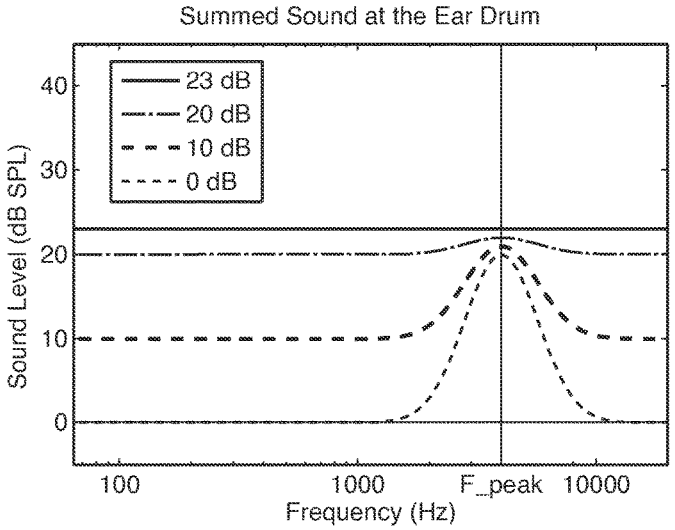
FIG. 4 is a graph of the output level of a hearing aid in accordance with the invention at the user's eardrum as a function of frequency and for different indicated flat (white noise) input sound pressure levels. It shows the decrease in gain of the hearing aid within a customized frequency band fitted to the user as the flat input SPL rises.

Reference is now made to an exemplary filter shape, which is represented in FIG. 4 and which is a band-pass filter with a peak frequency (F_peak) at 4 kHz. Such a filter corresponds to a typical noise-induced hearing loss of 20 dB at 4 kHz. In accordance with the invention, any filter shape can be realized by the coherent gate. First, the sound arriving and summed at the eardrum must be considered. As illustrated by FIG. 3, this is the combination of incident sound passing through the ear insert directly to the eardrum and the amplified sound. In the example shown in FIG. 4, the hearing aid boosts frequencies only around 4 kHz. For a flat input signal of 0 dB SPL, the output at 4 kHz is boosted to 20 dB SPL, making those frequencies now audible to the user. (Other parts of the frequency spectrum, already audible, aren't amplified.) Once the input level reaches 23 dB, the chosen cut-off level or threshold of audibility for a hypothetical wearer, the hearing aid essentially provides no amplified sound at 4 kHz (the gain is less than −20 dB). Above this threshold, the incident sound within the hearing loss frequency range will be perceived by the wearer without compensation. In this example, the incident sound producing the input signals for processing are first considered to be static, having a loudness and crest factor that don't vary in time.

Figure 5A:
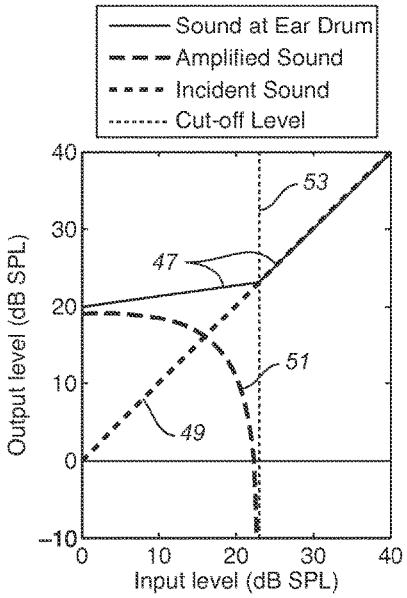
FIG. 5A is an input/output curve at the peak frequency of 4 kHz for the example shown in FIG. 4, showing perceived, amplified, and incident sound measured in dB SPL at the eardrum.
Figure 5B:
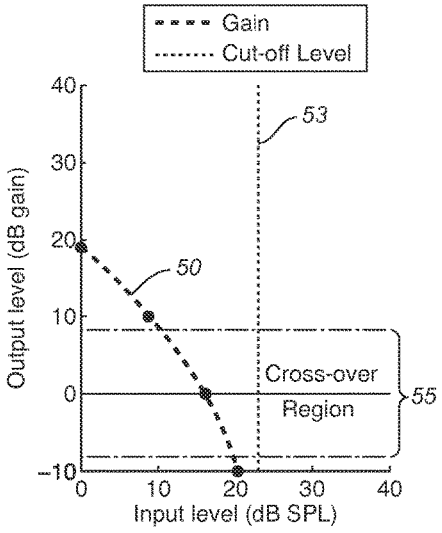
FIG. 5B is a gain function at the peak frequency of 4 kHz for the example shown in FIG. 4.

FIG. 5A shows the level of the incident sound (represented by dashed line 49) and the amplified sound (represented by dashed line 51, and the level of sound at the eardrum resulting from the summation of the two (represented by solid line 47), as a function of the input (incident) sound level; FIG. 5B show how the filter gain (represented by dashed line 50) changes as a function of the input sound level. As the input sound level changes, the gain parameters of the filter are made to change, resulting a sound level at the eardrum that changes. At low input sound levels (below approximately 10 dB), the sound arriving at the eardrum and ultimately the perceived sound is seen to be dominated by the amplified sound. In this low input region, the gain of the filter is seen to decrease almost linearly. Above this region is a "cross-over region" (denoted by the numeral 55 in FIG. 5B) where the difference between amplified sound 51 and incident sound 49 are less than about 8 dB. At levels within this cross-over region both incident and amplified sound contribute significantly to the sound arriving at the eardrum and to the perceived sound. As a result, there can be a desirable deviation from linearity in the gain function within this region (this deviation in the cross-over region can be noted in FIG. 5B). Nonetheless, to prevent perceptual artifacts in the cross-over region, changes in the gain function should be gradual; that is, it should be monotonically decreasing, without discontinuities, and smooth (in the mathematical sense, with continuous derivatives). Effectively, such a well-defined gain function maps similar input levels to similar output levels; a small change in input level causes a small change to the output level. While the optimal gain function is nonlinear as shown in FIG. 5B, it should be noted that a linear gain function, which is effective and easier to implement, could also be used.

Figure 6:
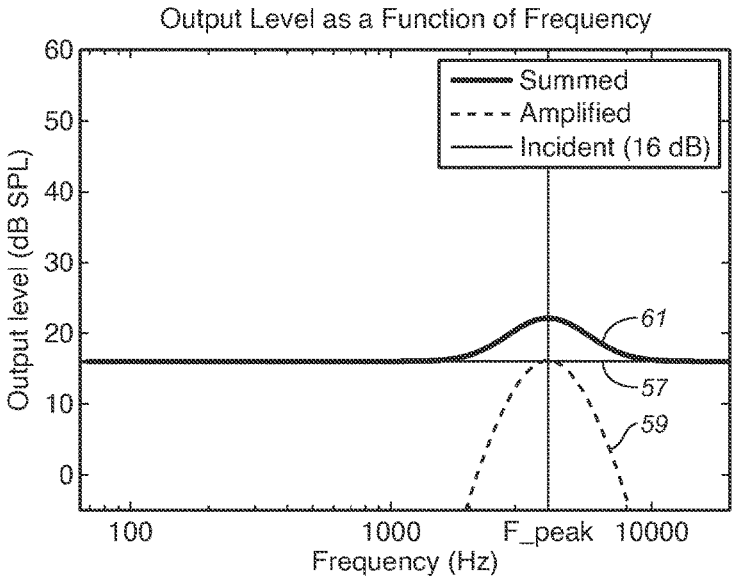
FIG. 6 is a graph showing incident sound and sound amplified by a hearing aid in accordance with the invention and their summation at the eardrum for an input sound with an SPL level slightly below the cross-over point.

FIG. 6 shows incident sound (represented by line 57) and amplified sound (represented by line 59) and their summation (represented by line 61) at the eardrum for incident sound having a sound pressure level within the cross-over region (input level at 16 dB). In the cross-over region, the phase and delay characteristics of the amplified sound are particularly important. The frequency-dependent phase must gradually approach zero as the filter gain decreases (just as the gain function changes). As with the amplified sound pressure level, if the phase changes dramatically between slight changes in input level, it will be noticed by the wearer of the device.

Figure 7:
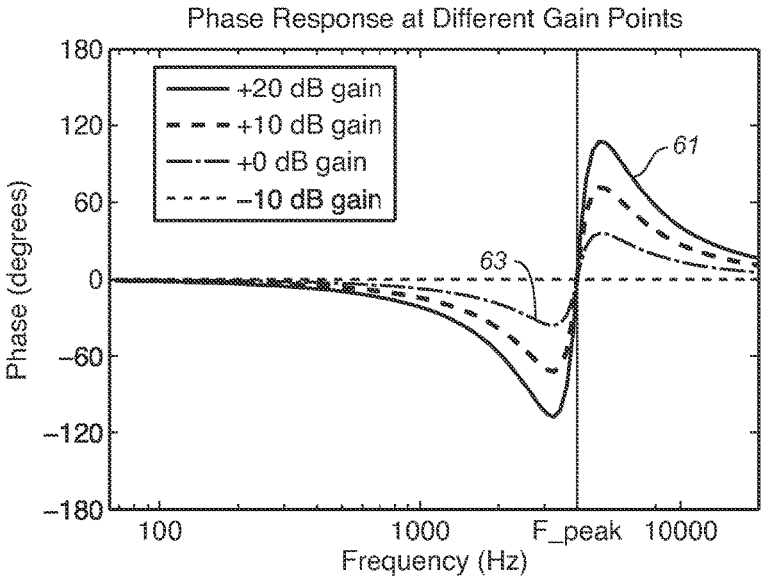
FIG. 7 is a graph of phase as a function of frequency at the gain levels indicated on FIG. 5.

One way to avoid unacceptably large and perceptible phase changes with small changes in input level is illustrated in FIG. 7, which shows the phase perturbation slowly decreasing to zero as the input level rises and the system gain decreases. FIG. 7 shows phase as a function of frequency at the gain levels indicated on FIG. 5B. As the gain decreases to below zero, the phase perturbation also decreases. For example, at +20 dB gain the phase perturbation (represented by graph line 61) is large as compared to the phase perturbation at 0 dB (represented by graph line 63). At −10 dB there is virtually no phase perturbation. Although filters that provide frequency-dependent gain necessarily introduce a phase shift, this shift can be minimized by selecting an appropriate filter implementation (e.g., minimum phase filters).

The other important parameter of the hearing aid is latency, the time between the incident sound's arrival at the microphone and the output of the amplified sound at the loudspeaker. This delay needs to be kept as small as possible, ideally less than 1 millisecond. Delays longer than −5 milliseconds create artifacts of coloration, while delays longer than 1 millisecond affect sound localization cues. Thus, preferably, the latency introduced by the coherent gate 15 of the signal processing circuit illustrated in FIG. 1 will be less than 1 millisecond.

In order to realize the benefits of the above-described processing scheme, the input transducer (microphone) and output transducer (loudspeaker) should be capable of reproducing the audio signal with great fidelity. The equal-phase response of the coherent gate will not be realized unless both the input and output transducers are linear, that is, unless they have a flat phase response and low harmonic distortion (preferably less than 1%) at the loudest expected output level.

Figure 8:
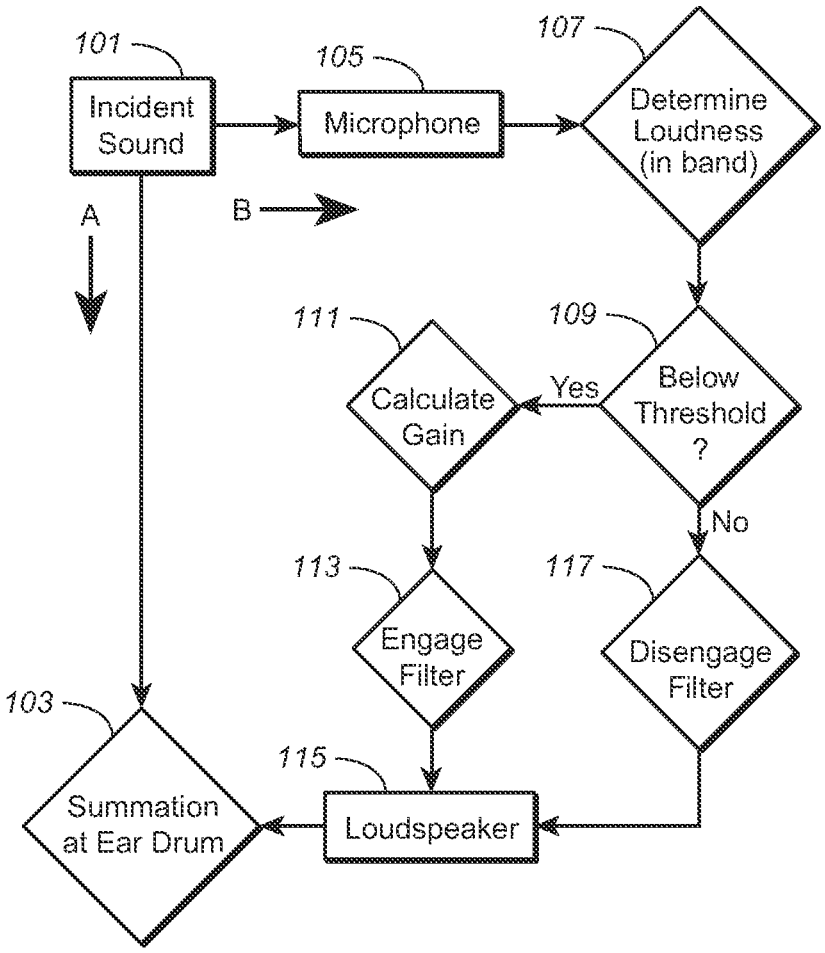
FIG. 8 is a flow chart illustrating the overall method of the invention.

FIG. 8 illustrates the general methodology of the above-described embodiment of the invention, where incident sound, represented by block 101 can arrive at wearer's eardrum via two paths, represented by arrows A and B, where it is summed, as represented by block 103. As shown in FIG. 8, the first path (path A) is a direct open ear path to the eardrum permitted by the open-ear configuration of the ear insert for the hearing aid. Incident sound will always arrive at the eardrum via this path. The path (path B) is a processed signal path that provides to the eardrum amplified sound that is dependent on frequency and incident sound level. Via this path, incident sound that has been converted to an electrical audio signal is processed by a variable gain gating function, shown as a coherent gate 15 in FIG. 1, wherein the incident sound arriving at the eardrum via path A is augmented by amplified sound arriving via path B. The level of the sound arriving from path B not only depends on the band of frequencies where compensation for hearing loss occurs, but also by the level of incident sound at any point of time. The characteristics of the variable gain function for amplifying the audio signal processed through this path will be tailored to the measured hearing loss profile of the wearer, including the wearer's threshold of audibility.

More particularly, in the processed signal path B, incident sound is introduced to this path via microphone 105, which converts the sound to an electrical audio signal that can be processed by analog circuits or most preferably by digital signal processing. The processing steps include first determining loudness of the incident sound in the frequency band or bands of interest (block 107). If the loudness of the incident sound picked up by the microphone is below the measured threshold of audibility for the wearer (block 109), the gain necessary to compensate for the wearer's measured hearing loss, that is, to bring the below threshold sound up to an audible level for the wearer, is determined such as by a gain calculation (block 111). Based on this determined gain, the filter of the coherent gate is engaged (block 113) to allow the audio signal passing through path B to be amplified to a level determined by the gain. As earlier described, the engagement of the filter can be under dynamic control such that the attack time can be set at desired levels. The resulting amplified sound is used to drive loudspeaker 115 of an ear insert. The output from the loudspeaker produces amplified sound that is summed with incident sound at the eardrum.

If on the other hand the loudness of the incident sound picked up by the microphone is above the measured threshold of audibility for the wearer (back to block 109), the filter of the coherent gate is disengaged (block 117), thus removing any audio signal that may drive the loudspeaker 115. As with the engagement of the filter, disengagement of the filter can be under dynamic control wherein the release time can be set as earlier described. During release, amplified sound will continue to drive loudspeaker 115 for a very short period of time.

While the invention has been described in detail in the foregoing specification, it is not intended that the invention be limited to such detail, except as necessitated be the following claims.

What we claim is:

1. A hearing aid for compensating for loss of hearing in a human ear wherein the ear is characterized by an ear canal that terminates at an eardrum and wherein the hearing capabilities of an individual are defined by a frequency dependent threshold of audibility, comprising:

a microphone for picking up incident sound receivable by the human ear and converting it to an electrical audio signal, the incident sound being characterized by varying sound pressure levels, an analog-to-digital converter for converting the electrical audio signal produced by the microphone to a digital audio signal, an earpiece including an output transducer, said earpiece being positionable within the ear canal of the human ear for producing a sound output in response to incident sound picked-up by said microphone, said earpiece being acoustically transparent to allow incident sound to reach the eardrum without amplification, and a digital signal processor for processing the digital audio signal resulting from incident sound picked-up by the microphone, said digital signal processor providing a processed digital audio signal convertible to an electrical audio signal for driving the output transducer of the earpiece to produce the sound output from the output transducer having the following characteristics:

i) the sound output is amplified within a frequency band where the individual's threshold of audibility is identified as contributing to hearing loss; and ii) a gain of the amplified sound output within such frequency band continuously decreases from a maximum gain at the lowest incident sound pressure levels to a minimum gain at incident sound pressure levels near a set cut-off sound pressure level for incident sound, wherein the cut-off level is set based on the individual's threshold of audibility, and iii) above the set cut-off level the sound perceived by the individual wearing the hearing aid is almost entirely the result of incident sound that reaches the eardrum with no amplification.

2. The hearing aid of claim 1 wherein, when transitioning between a state where the sound output is amplified and where the output transducer produces substantially no sound output, the transition is under dynamic control to produce desired attack and release times.

3. The hearing aid of claim 1 wherein the gain of the amplified sound output within the frequency band decreases substantially linearly with increasing incident sound pressure levels.

4. The hearing aid of claim 1 wherein the gain of the amplified sound output within said frequency band decreases monotonically and without discontinuities near the cut-off sound pressure level for incident sound.

5. The hearing aid of claim 1 wherein a phase distortion of the amplified sound output within said frequency band approaches zero near the cut-off sound pressure level for incident sound and becomes zero when the incident sound pressure level substantially exceeds the cut-off level.

6. The hearing aid of claim 5 wherein the phase, distortion of the amplified sound output within said frequency band approaches zero monotonically and without discontinuities near the cut-off sound pressure level for incident sound.

7. A hearing aid for compensating for loss of hearing in a human ear wherein the ear is characterized by an ear canal that terminates at an eardrum and wherein the hearing capabilities of an individual are defined by a threshold of audibility, comprising:

a microphone for picking up incident sound to be received by the human ear and converting it to an electrical audio signal, the incident sound being characterized by varying sound pressure levels, an analog-to-digital converter for converting the electrical audio signal produced by the microphone to a digital audio signal, an earpiece including an output transducer, said earpiece being positionable within the ear canal of the human ear for producing a sound output in response to incident sound picked-up by said microphone, said earpiece being acoustically transparent to allow incident sound to reach the eardrum without amplification, and a digital signal processor for processing the digital audio signal resulting from incident sound picked-up by the microphone, said digital signal processor having a digital signal output, a digital-to-analog converter for converting the digital signal output of the digital signal processor to a processed electrical audio signal, an amplifier for receiving and amplifying, the processed electrical audio signal to produce an amplified electrical audio signal for driving the output transducer of the earpiece such that the output transducer produces amplified sound output, the digital signal processor being configured to cause the output transducer of the earpiece to produce the amplified sound output having the following characteristics:

i) the sound output is amplified within a frequency band where the individual's threshold of audibility is identified as contributing to hearing loss; and ii) a gain of the amplified sound output within such frequency band continuously decreases from a maximum gain at the lowest incident sound pressure levels to a minimum gain at incident sound pressure levels near a set cut-off sound pressure level for incident sound, wherein the cut-off level is set based on the individual's threshold of audibility.

8. The hearing aid of claim 7 wherein, when transitioning between a state where the sound output is amplified and where the output transducer produces substantially no sound output, the transition is under dynamic control to produce desired attack and release times.

9. The hearing aid of claim 7 wherein the gain of the amplified sound, output within the frequency band decreases substantially linearly with increasing incident sound pressure levels.

10. The hearing aid of claim 7 wherein the gain of the amplified s output within said frequency band decreases monotonically and without discontinuities near the cut-off sound pressure level for incident sound.

11. The hearing aid of claim 7 wherein a phase distortion of the amplified sound output within said frequency band approaches zero near the cut-off sound pressure level for incident sound and becomes zero when the incident sound pressure level substantially exceeds the cut-off level.

12. The hearing aid of claim 11 wherein the phase distortion of the amplified sound output within said frequency band approaches zero monotonically and without discontinuities near the cut-off sound pressure level for incident sound.

* * * * *